US009362690B2

(12) United States Patent
Huang

(10) Patent No.: US 9,362,690 B2
(45) Date of Patent: Jun. 7, 2016

(54) ELECTRIC CONNECTOR AND TEMPERATURE-SENSING MECHANISM WITHIN

(71) Applicant: DELTA ELECTRONICS, INC., Taoyuan Hsien (TW)

(72) Inventor: Chin-Chu Huang, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 0 days.

(21) Appl. No.: 14/510,399

(22) Filed: Oct. 9, 2014

(65) Prior Publication Data

US 2016/0013597 A1 Jan. 14, 2016

(30) Foreign Application Priority Data

Jul. 11, 2014 (TW) ..... 103123886 A

(51) Int. Cl.
*H01R 13/66* (2006.01)
*H01R 24/30* (2011.01)
*H01R 103/00* (2006.01)

(52) U.S. Cl.
CPC ..... *H01R 24/30* (2013.01); *H01R 13/6683* (2013.01); *H01R 2103/00* (2013.01)

(58) Field of Classification Search
CPC .. H01R 13/6616; H05B 3/746; H01C 1/1406; H01C 1/1413
USPC ..... 439/620.21; 374/141; 219/448.11; 338/22 R, 200
See application file for complete search history.

(56) References Cited

U.S. PATENT DOCUMENTS 4,310,837 A * 1/1982 Kornrumpf ..... G01K 3/00 340/598
4,644,316 A * 2/1987 Takeuchi ..... G05D 23/2401 219/544
2014/0073189 A1 3/2014 Kondou et al.

FOREIGN PATENT DOCUMENTS

TW M443313 12/2012

* cited by examiner

*Primary Examiner* — Vanessa Girardi
(74) *Attorney, Agent, or Firm* — Kirton McConkie; Evan R. Witt

(57) ABSTRACT

An electric connector includes a first pin, a second pin, a thermal conductor and a temperature sensor. The thermal conductor is disposed between the first pin and the second pin and simultaneously connected with the first pin and the second pin. The temperature sensor is embedded in the thermal conductor for sensing the temperature of the first pin and the second pin. Therefore, the thermal energy is rapidly and effectively transferred from the first pin and the second pin to the temperature sensor disposed in the thermal conductor, so that the temperature is precisely monitored and is rapidly reflected, and the safety of the electric connector is enhanced.

16 Claims, 6 Drawing Sheets

ELECTRIC CONNECTOR AND TEMPERATURE-SENSING MECHANISM WITHIN

FIELD OF THE INVENTION

The present invention relates to an electric connector, and more particularly to an electric connector and a temperature-sensing mechanism thereof for being applied in an AC source.

BACKGROUND OF THE INVENTION

In the use of an electronic device or an electronic apparatus, an AC plug or an AC connector is utilized for powering of an AC source. The electronic device or the electronic apparatus is powered and charged by the mains electricity or a power supply through the connection of the AC connector and the AC source.

Please refer to FIG. 1. FIG. 1 schematically illustrates the structure of an electric connector of prior art. During powering, if a high energy of the electricity is required or the electronic device or the electronic apparatus is required to be operated in a high voltage environment for a long time, the temperatures of an electric connector 1 of prior art and a wire connected thereto are risen, and then there is a risk of burning or melting of the socket and the housing 10 of the electric connector 1. In other words, when the electric connector 1 is inserted into the socket for powering, the high temperature is continuously conducted by the pins 11 due to the characteristics of the pins 11, such that the temperatures of the wire 2 and the entirety of the electric connector 1 are continuously increased, thereby being melted or burned.

To solve this problem, an electric connector having a temperature sensor, which is connected with single one pin, is developed. Please refer to FIG. 2. FIG. 2 schematically illustrates the internal structure of an electric connector and a temperature sensor thereof of prior art. As shown in FIG. 2, the electric connector 3 has pins 31 and a temperature sensor 32. The temperature sensor 32 is disposed near single one pin of the pins 31 for sensing the change of temperature of the single one pin. The change of the temperature can be sensed and monitored.

However, since the temperature sensor 32 is only connected with single one pin of the pins 31 but not connected with all of the pins 31, and there is a temperature gradient between the temperature sensor 32 and the single one pin of the pins 31, the precise temperature of the single one pin of the pins 31 still cannot be measured. Under this circumstance, there may exist a huge difference between the measured temperature and the actual temperature, causes that the change of temperature cannot be responded in time. Moreover, the precise temperature sensing and monitoring cannot be effectively implemented, and the risk of burning or melting of the socket and the electric connector 3 still remains.

Therefore, there is a need of providing an improved electric connector and an improved temperature-sensing mechanism thereof in order to eliminate the above drawbacks.

SUMMARY OF THE INVENTION

It is an object of the present invention to provide an electric connector and a temperature-sensing mechanism thereof in order to overcome the above-mentioned drawbacks encountered by the prior arts.

The present invention also provides an electric connector and a temperature-sensing mechanism thereof. Since a thermal conductor is simultaneously connected with the first pin and the second pin, the thermal energy is rapidly and effectively transferred from the first pin and the second pin to a temperature sensor disposed in the thermal conductor, such that the temperature is precisely monitored and is rapidly reflected, and the safety of the electric connector is enhanced.

In accordance with an aspect of the present invention, there is provided an electric connector. The electric connector includes a first pin, a second pin, a thermal conductor and a temperature sensor. The thermal conductor is disposed between the first pin and the second pin and simultaneously connected with the first pin and the second pin. The temperature sensor is embedded in the thermal conductor for sensing the temperature of the first pin and the second pin.

In accordance with another aspect of the present invention, there is provided a temperature-sensing mechanism of an electric connector. The electric connector includes a first pin and a second pin. The temperature-sensing mechanism includes a thermal conductor and a temperature sensor. The thermal conductor is disposed between the first pin and the second pin and simultaneously connected with the first pin and the second pin. The temperature sensor is embedded in the thermal conductor for sensing the temperature of the first pin and the second pin.

In accordance with a further aspect of the present invention, there is provided an electric connector. The electric connector includes a first pin, a second pin, a thermal conductor and a temperature sensor. The thermal conductor has a connecting portion, a first end portion and a second end portion. The connecting portion is disposed between the first pin and the second pin for connecting the first end portion and the second end portion, and the first end portion and the second end portion are connected with the first pin and the second pin, respectively. The temperature sensor is embedded in the connecting portion of the thermal conductor for sensing the temperature of the first pin and the second pin.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
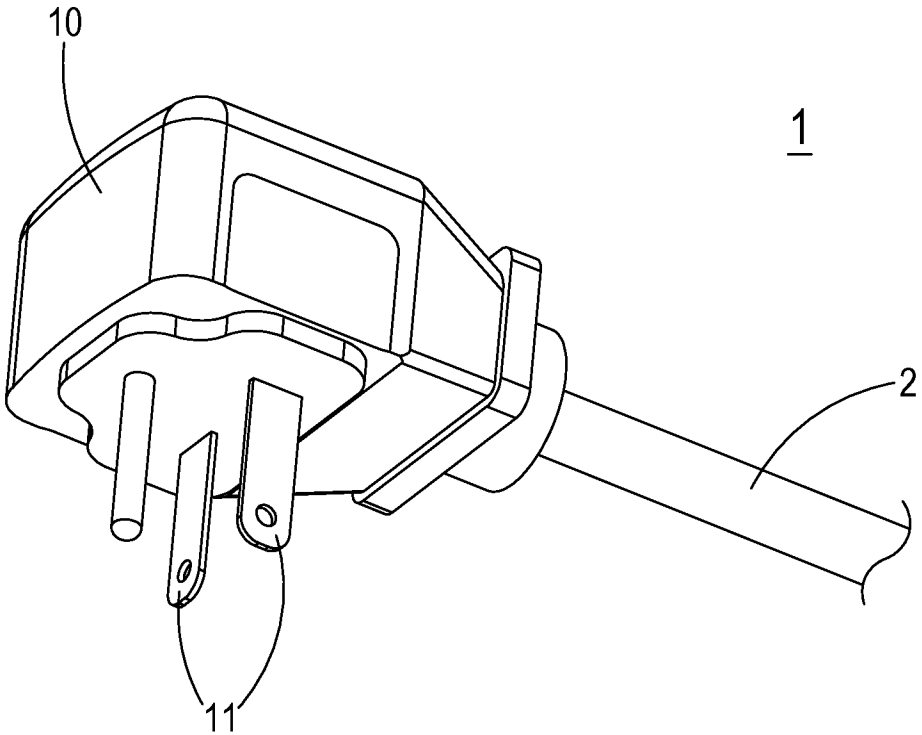
FIG. 1 PRIOR ART
FIG. 1 schematically illustrates the structure of an electric connector of prior art.
Figure 2:
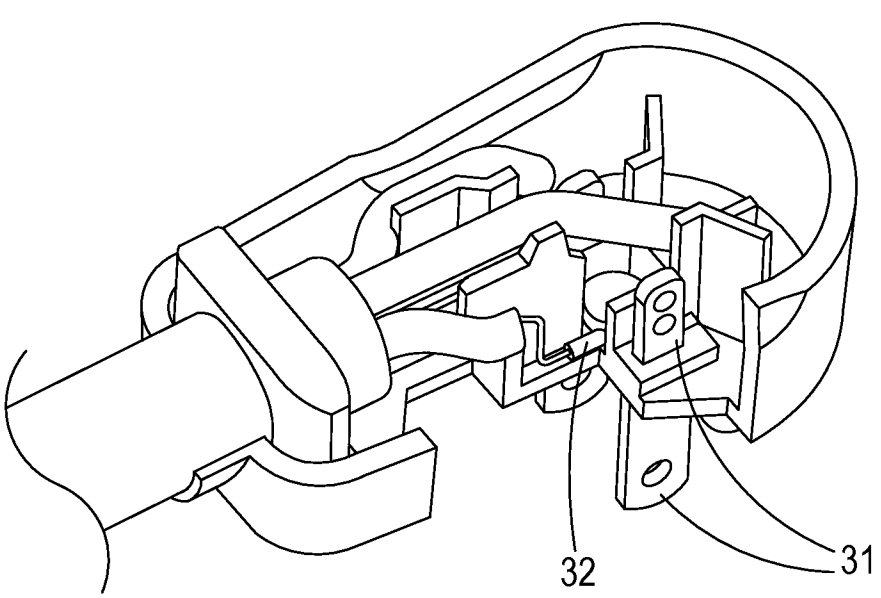
FIG. 2 PRIOR ART
FIG. 2 schematically illustrates the internal structure of an electric connector and a temperature sensor thereof of prior art.
Figure 3:
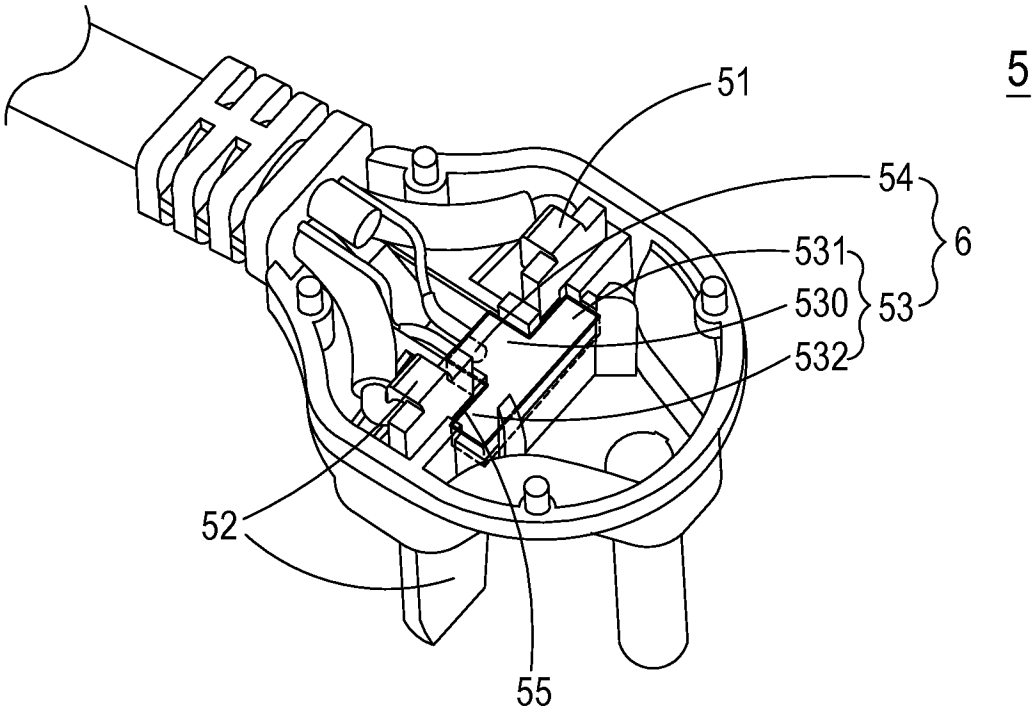
FIG. 3 schematically illustrates the internal structure of an electric connector according to an embodiment of the present invention.

FIG. 3 schematically illustrates the internal structure of an electric connector according to an embodiment of the present invention. As shown in FIG. 3, the electric connector 5 of the present disclosure includes a first pin 51, a second pin 52, a thermal conductor 53 and a temperature sensor 54. The first pin 51 is not limited to be connected with a live wire of an AC source, and the second pin 52 is not limited to be connected with a neutral wire of the AC source. In some embodiments, the first pin 51 is connected with a neutral wire of an AC source, and the second pin 52 is connected with a live wire of the AC source, but not limited thereto. The thermal conductor 53 is disposed between the first pin 51 and the second pin 52 and simultaneously connected with the first pin 51 and the second pin 52. The temperature sensor 54 is embedded in the thermal conductor 53 for sensing the temperature of the first pin 51 and the second pin 52, among which the temperature sensor 54 is drawn as dashed line in the figures.

In some embodiments, the thermal conductor 53 has a connecting portion 530, a first end portion 531 and a second end portion 532. The connecting portion 530 is disposed between the first pin 51 and the second pin 52 for connecting the first end portion 531 and the second end portion 532 and accommodating the temperature sensor 54. In other words, the temperature sensor 54 is embedded in the connecting portion 530 of the thermal conductor 53. The first end portion 531 and the second end portion 532 of the thermal conductor 53 are connected with the first pin 51 and the second pin 52, respectively, for respectively transferring the thermal energy from the first pin 51 and the second pin 52 to the connecting portion 530 through the first end portion 531 and the second end portion 532. Therefore, the temperature and the change of temperature are sensed by the temperature sensor 54 embedded in the connecting portion 530. As a result, the temperature is precisely monitored and rapidly reflected by the electric connector 5 of the present invention, and the safety of the entirety of the electric connector 5 is enhanced.

In addition, the thermal conductor 53 and the temperature sensor 54 can be used for not only sensing the temperature of the first pin 51 and the second pin 52 of the electric connector 5, but also sensing the temperature and the change of temperature of any type of the electric connector. Certainly, the temperature of the electric connector, which is preferred to have a first pin and a second pin, developed or designed in the future can be also sensed by the thermal conductor 53 and the temperature sensor 54. In other words, the thermal conductor 53 and the temperature sensor 54 of the present invention can be assembled or configured as a temperature-sensing mechanism 6, but not limited thereto.

In some embodiments, the thermal conductor 53 is an electrical insulator, and is preferably made of a ceramic material. For achieving the advantages of the present invention mentioned above, the thermal conductivity of the thermal conductor 53 is preferably greater than the thermal conductivity of copper (i.e. the thermal conductivity of the thermal conductor 53 is far greater than the thermal conductivity of materials of prior art). In other words, since the first pin 51 and the second 52 are commonly made of copper, the advantages of the present invention can be implemented by utilizing the thermal conductor 53, which is made of a ceramic material, having the thermal conductivity greater than the thermal conductivity of copper. Meanwhile, the safety of the electric connector 5 is enhanced.

Furthermore, the electric connector 5 of the present disclosure further includes a thermal conductive medium 55 disposed between the thermal conductor 53 and the first pin 51 and between the thermal conductor 53 and the second pin 52. Certainly, the thermal conductor 53 can be not only simultaneously disposed between the thermal conductor 53 and the first pin 51 and between the thermal conductor 53 and the second pin 52, but also individually disposed between the thermal conductor 53 and the first pin 51 or between the thermal conductor 53 and the second pin 52, for filling the air gap between the thermal conductor 53 and the first pin 51 or the air gap between the thermal conductor 53 and the second pin 52, thereby enhancing the efficiency of thermal conduction. Since the propose of disposing the thermal conductive medium 55 is enhancing the thermal conduction between the thermal conductor 53 and the first pin 51 and the thermal conduction between the thermal conductor 53 and the second pin 52, the thermal conductivity of the thermal conductive medium 55 is required to be greater than the thermal conductivity of air, such that the air gap can be replaced by the thermal conductive medium 55. For example, the thermal conductivity k of the air is about 0.028 W/m·K. The thermal conductivity k of the thermal conductive medium 55 of the present invention is preferably greater than or equal to 0.7 W/m·K and less than or equal to 0.9 W/m·K, but not limited herein.

Figure 4:
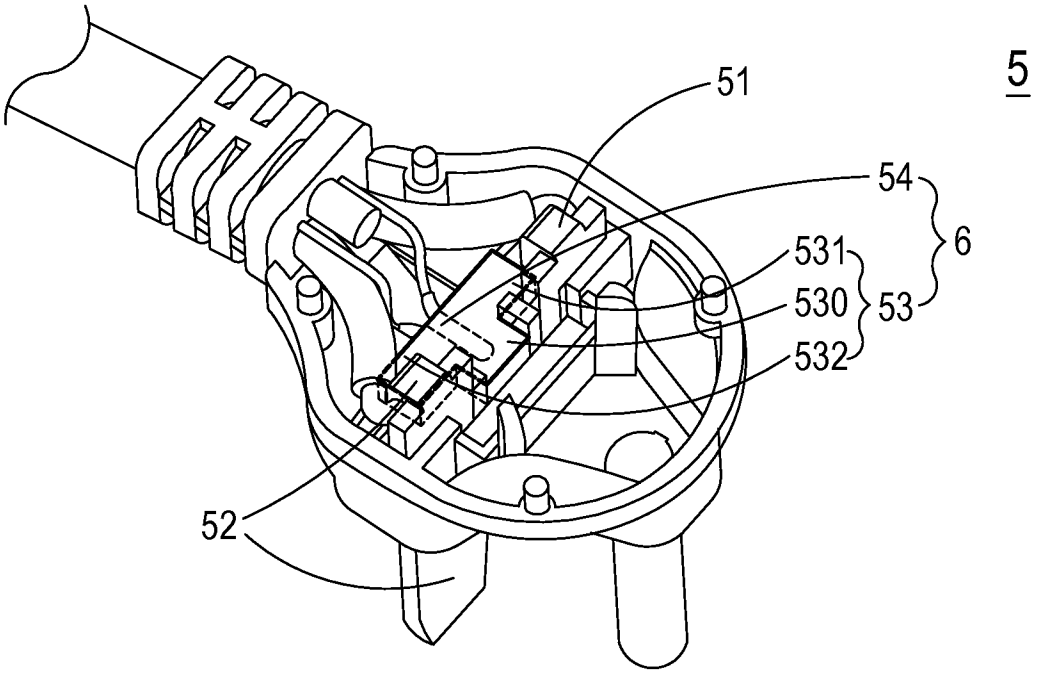
FIG. 4 schematically illustrates the internal structure of an electric connector according to one embodiment of the present invention.

In some embodiments, the thermal conductor 53 of the electric connector 5 may be T-shaped as described in above-mentioned embodiments or counter-T-shaped in another embodiment. Please refer to FIG. 4. FIG. 4 schematically illustrates the internal structure of an electric connector according to one embodiment of the present invention. As shown in FIG. 4, the electric connector 5 includes a first pin 51, a second pin 52, a thermal conductor 53 and a temperature sensor 54. The first pin 51, the second pin 52, the thermal conductor 53 and the temperature sensor 54 are similar with the embodiments mentioned above, and are not redundantly described herein. In the previously described embodiments, the first end portion 531 and the second end portion 532 of the thermal conductor 53 are correspondingly disposed on one side of the first pin 51 and the second pin 52 and structured with the connecting portion 530 as a T-shaped thermal conductor 53. In the present embodiment, the first end portion 531 and the second end portion 532 of the thermal conductor 53 are correspondingly disposed on the other side of the first pin 51 and the second pin 52 and structured with the connecting portion 530 as a counter-T-shaped thermal conductor 53. The counter-T-shaped thermal conductor 53 is configured to have the similar function and characteristic as the T-shaped thermal conductor 53, and can also be assembled or configured with the temperature sensor 54 as a temperature-sensing mechanism 6.

Figure 5:
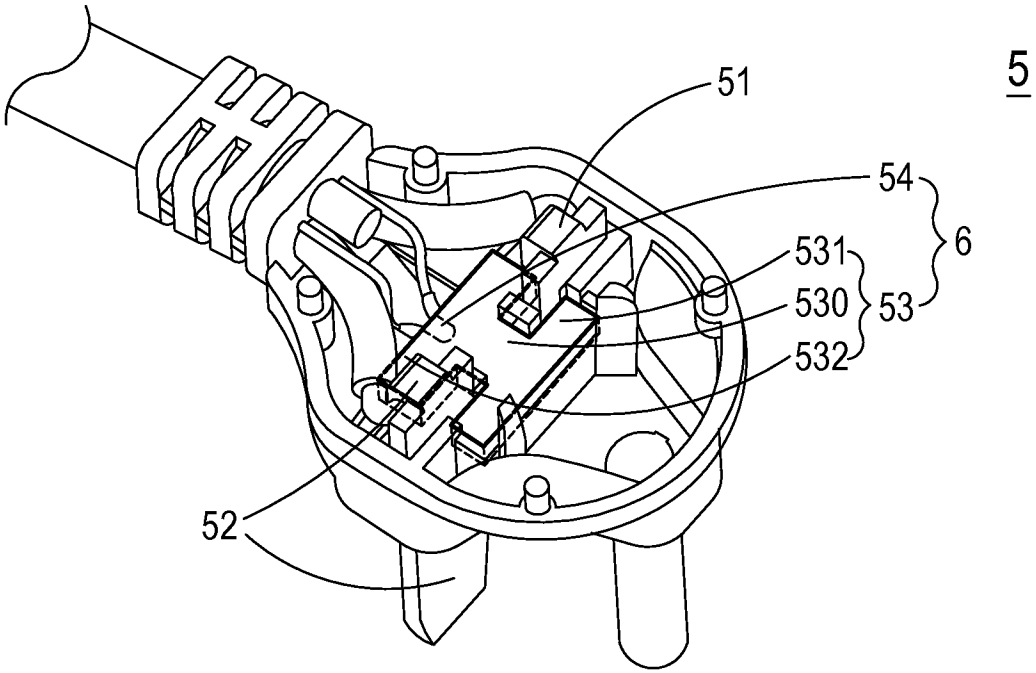
FIG. 5 schematically illustrates the internal structure of an electric connector according to another embodiment of the present invention.

In some embodiments, the thermal conductor 53 of the electric connector 5 is H-shaped. Please refer to FIG. 5. FIG. 5 schematically illustrates the internal structure of an electric connector according to another embodiment of the present invention. As shown in FIG. 5, the electric connector 5 includes a first pin 51, a second pin 52, a thermal conductor 53 and a temperature sensor 54. The first pin 51, the second pin 52, the thermal conductor 53 and the temperature sensor 54 are similar with the embodiments mentioned above, and are not redundantly described herein. In the present embodiment, the first end portion 531 and the second end portion 532 are correspondingly disposed on two sides of the first pin 51 and the second pin 52, simultaneously, and structured with the connecting portion 530 as a H-shaped thermal conductor 53. The H-shaped thermal conductor 53 is configured to have the similar function and characteristic as the T-shaped thermal conductor 53 and the counter-T-shaped thermal conductor 53, and can also be assembled or configured with the temperature sensor 54 as a temperature-sensing mechanism 6.

Figure 6:
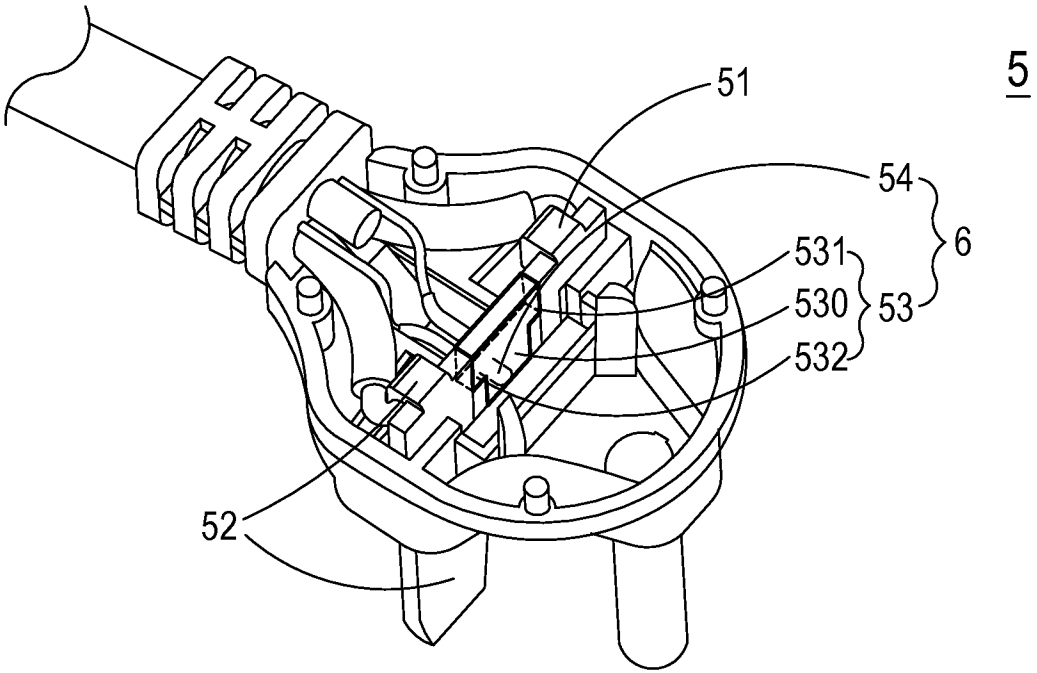
FIG. 6 schematically illustrates the internal structure of an electric connector according to still another embodiment of the present invention.

In some embodiments, the thermal conductor 53 of the electric connector 5 is I-shaped. Please refer to FIG. 6. FIG. 6 schematically illustrates the internal structure of an electric connector according to still another embodiment of the present invention. As shown in FIG. 6, the electric connector 5 includes a first pin 51, a second pin 52, a thermal conductor 53 and a temperature sensor 54. The first pin 51, the second pin 52, the thermal conductor 53 and the temperature sensor 54 are similar with the embodiments mentioned above, and are not redundantly described herein. In the present embodiment, the first end portion 531 and the second end portion 532 are simultaneously disposed between the first pin 51 and the second pin 52, and structured with the connecting portion 530 as an I-shaped thermal conductor 53. The I-shaped thermal conductor 53 is configured to have the similar function and characteristic as the T-shaped thermal conductor 53, the counter-T-shaped thermal conductor 53 and the H-shaped thermal conductor 53, and can also be assembled or configured with the temperature sensor 54 as a temperature-sensing mechanism 6.

From the above descriptions, the present invention provides an electric connector and a temperature-sensing mechanism thereof in order to overcome the above-mentioned drawbacks encountered by the prior arts. Meanwhile, the present invention also provides an electric connector and a temperature-sensing mechanism thereof. Since a thermal conductor is simultaneously connected with the first pin and the second pin, the thermal energy is rapidly and effectively transferred from the first pin and the second pin to a temperature sensor disposed in the thermal conductor, such that the temperature is precisely monitored and is rapidly reflected, and the safety of the electric connector is enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electric connector, comprising:

a first pin;

a second pin;

a thermal conductor having a connecting portion, a first end portion and a second end portion, wherein the connecting portion is disposed between the first pin and the second pin for connecting the first end portion and the second end portion, and the first end portion and the second end portion are connected with the first pin and the second pin, respectively, and wherein the first end portion and the second end portion are correspondingly disposed on two sides of the first pin and the second pin, simultaneously; and a temperature sensor embedded in the connecting portion of the thermal conductor for sensing the temperature of the first pin and the second pin.

2. A temperature-sensing mechanism of an electric connector, the electric connector comprising a first pin and a second pin, the temperature-sensing mechanism comprising:

a thermal conductor disposed between the first pin and the second pin and simultaneously connected with the first pin and the second pin, wherein the thermal conductor has a connecting portion, a first end portion and a second end portion, the connecting portion is disposed between the first pin and the second pin for connecting the first end portion and the second end portion, and the first end portion and the second end portion are connected with the first pin and the second pin, respectively, and wherein the first end portion and the second end portion are correspondingly disposed on two sides of the first pin and the second pin, simultaneously; and a temperature sensor embedded in the thermal conductor for sensing the temperature of the first pin and the second pin.

3. A electric connector, comprising:

a first pin;

a second pin;

a thermal conductor disposed between the first pin and the second pin and simultaneously connected with the first pin and the second pin, wherein the thermal conductor has a connecting portion, a first end portion and a second end portion, the connecting portion is disposed between the first pin and the second pin for connecting the first end portion and the second end portion, and the first end portion and the second end portion are connected with the first pin and the second pin, respectively, and wherein the first end portion and the second end portion are correspondingly disposed on two sides of the first pin and the second pin, simultaneously; and a temperature sensor embedded in the thermal conductor for sensing the temperature of the first pin and the second pin.

4. The electric connector according to claim 3, wherein the thermal conductor is T-shaped, H-shaped or I-shaped.

5. The electric connector according to claim 3, wherein the thermal conductivity of the thermal conductor is greater than the thermal conductivity of copper.

6. The electric connector according to claim 3, wherein the temperature sensor is embedded in the connecting portion of the thermal conductor.

7. The electric connector according to claim 3, wherein the first pin is connected with a live wire of an AC source, and the second pin is connected with a neutral wire of the AC source.

8. The electric connector according to claim 3, wherein the first pin is connected with a neutral wire of an AC source, and the second pin is connected with a live wire of the AC source.

9. The electric connector according to claim 3, wherein the thermal conductor is an electrical insulator.

10. The electric connector according to claim 9, wherein the thermal conductor is made of a ceramic material.

11. The electric connector according to claim 3, further comprising a thermal conductive medium disposed between the thermal conductor and the first pin and between the thermal conductor and the second pin.

12. The electric connector according to claim 11, wherein the thermal conductivity of the thermal conductive medium is greater than the thermal conductivity of air.

13. The electric connector according to claim 12, wherein the thermal conductivity of the thermal conductive medium is greater than or equal to 0.7 W/m·K and less than or equal to 0.9 W/m·K.

14. The electric connector according to claim 3, further comprising a thermal conductive medium disposed between the thermal conductor and the first pin or between the thermal conductor and the second pin.

15. The electric connector according to claim 14, wherein the thermal conductivity of the thermal conductive medium is greater than the thermal conductivity of air.

16. The electric connector according to claim 15, wherein the thermal conductivity of the thermal conductive medium is greater than or equal to 0.7 W/m·K and less than or equal to 0.9 W/m·K.

* * * * *